US005717319A

United States Patent [19]

Jokinen

[11] Patent Number: 5,717,319

[45] Date of Patent: Feb. 10, 1998

[54] METHOD TO REDUCE THE POWER CONSUMPTION OF AN ELECTRONIC DEVICE COMPRISING A VOLTAGE REGULATOR

[75] Inventor: Harri Jokinen, Hiisi, Finland

[73] Assignee: Nokia Mobile Phones Ltd., Salo, Finland

[21] Appl. No.: 485,999

[22] Filed: Jun. 8, 1995

[30] Foreign Application Priority Data

Jun. 10, 1994 [FI] Finland ..... 942753

[51] Int. Cl.[6] ..... G05F 1/575

[52] U.S. Cl. ..... 323/280; 323/269; 323/281

[58] Field of Search ..... 323/269, 273, 323/274, 280, 281

[56] References Cited

U.S. PATENT DOCUMENTS

| | | | |
|---|---|---|---|
| 4,634,956 | 1/1987 | Davis et al. | 323/222 |
| 5,291,542 | 3/1994 | Kivari et al. | 379/58 |
| 5,339,460 | 8/1994 | Sadata et al. | 455/343 |
| 5,353,215 | 10/1994 | Dinwiddie et al. | 323/281 X |
| 5,378,935 | 1/1995 | Korhonen et al. | 327/114 |
| 5,416,435 | 5/1995 | Jokinen et al. | 327/113 |
| 5,532,576 | 7/1996 | MacRobbie et al. | 323/274 |

*Primary Examiner*—Peter S. Wong
*Assistant Examiner*—Y. J. Han
*Attorney, Agent, or Firm*—Perman & Green, LLP

[57] ABSTRACT

The invention relates to a method to reduce the power consumption of an electronic device comprising at least one voltage regulator. At least one of the regulators (REG1–REG4) is switched off and on according to a predetermined duty cycle during such periods when the electronic device does not require the normal power supply ability of the regulator. This may be realized e.g. in a mobile phone during two successive control channel messages received from a base station when the mobile phone is in a so called power saving mode.

6 Claims, 5 Drawing Sheets

METHOD TO REDUCE THE POWER CONSUMPTION OF AN ELECTRONIC DEVICE COMPRISING A VOLTAGE REGULATOR

BACKGROUND OF THE INVENTION

The present invention relates to a method to reduce the power consumption of an electronic device, preferably a batten powered device comprising at least one voltage regulator, and to a device comprising at least one voltage regulator.

Nowadays a multitude of different battery powered devices are available to the consumer. These devices include e.g. mobile phones, portable computers, portable telefax terminals, portable copying machines, portable oscilloscopes and other measuring equipment, and for instance portable hospital equipment, and so on. Thus there are many alternatives. The present invention can be used in any electronic device, particularly in a battery powered device, and thus the invention is not restricted to any particular device. Here, a battery means any component which accumulates electrical energy, such as a rechargeable battery or a disposable battery, an accumulator or any corresponding component.

Below we consider a battery powered mobile phone as the electronic device, in order to illustrate the application area and the advantages of the invention and the disadvantages of prior art.

A cellular telephone system, such as the GSM, usually comprises a number of base stations providing service in a predetermined geographical area or cell. Each base station broadcasts messages to a number of mobile stations within the cell area. The mobile stations comprise a microprocessor and a transceiver and decoder controlled by the microprocessor. In battery powered mobile stations the battery usually will last about eight hours when the telephone is in the stand-by mode, and about one go two hours in the talk mode, in which the telephone transmits and receives data and/or speech, until it is necessary to replace or recharge the battery.

The mobile phone and the base station communicate via the radio path, which is a physical resource of the mobile phone network. The radio path will convey both speech and signaling information, which controls the functions of the telephone and the use of the radio path in the GSM mobile phone system for example, two frequency bands of 25 Mhz each are reserved for the radio path on the 900 Mhz band; the band 890–915 Mhz is reserved for uplink communication in the direction from the mobile phone to the base station (transmit frequency band), and 935–960 Mhz is reserved for the downlink direction from the base station to the telephone (receive frequency band). These frequency bands are divided in 124 frequency channels at intervals of 200 kHz, Each frequency channel is further divided in eight time slots, i.e. the GSM system utilizes time division multiple access (TDMA), where each mobile phone is allocated one time slog for the transmission and reception, so that each frequency channel of 200 kHz can simultaneously serve eight telephones. Thus the GSM system has a total of 992 channels, The GSM system, which is based on time division multiple access (TDMA) will not be described in greater detail here, because it is well known by a person skilled in the art, and the system is exactly specified in the so called GSM specifications and presented e.g. in the article M. R. L. Hodges: "The GSM radio interface", British Telecom Technological Journal, Vol. 8, No 1, 1990, p. 31–43, the contents of which is incorporated here as a reference.

In the GSM mobile system we know the concept of listening mode or "idle mode", in which the telephone waits for a paging message addressed for it, and listens to parameters (system information message) of neighbor cells as well as receives such messages. The paging message is a common concept in cellular mobile phone systems, and it is an impulse transmitted by the base station to the mobile station, with which the base station indicates to the mobile station that a call is arriving to this mobile station, whereby the mobile station calls the base station in order to establish communication between the mobile station and the base station.

In mobile phones we know a so called power saving mode in which the circuits, such as the microprocessor controlling the operation of the mobile phone, are switched into a power saving mode and in this power saving mode the clock frequencies are lowered, and some of the clocks are even stopped. The European patent publication EP-473 465 presents a way to utilize the power saving mode. Since in cellular mobile systems most messages transmitted by a base station to the mobile stations are intended for a single mobile station, only a small part of all messages transmitted by the base station are intended for a certain mobile station. So as not to have the mobile station to continuously receive and decode all messages broadcast by the base station, the European patent publication EP-473 465 proposes, in order to save power, that the messages received by the mobile station are detected to find out whether a received message is intended for another mobile station, and in this case the battery power is lowered (the power saving mode is activated) until the next message broadcast by the base station to this mobile station is expected to arrive. Battery saving according to the publication EP 473 465 is based on the receiving of a two-part message, the first part indicating that this message is intended for another mobile station, and that the message for this other mobile station contains a second part which, according to the publication EP 473 465, it is not necessary to receive if the message is addressed to another mobile station. Thus the mobile station can switch a considerable part of its receiving circuits into the power saving mode until the next message possibly directed to this mobile station is expected to arrive. This power saving mode is controlled by a timing circuit which may be programmed to contain, the start time of a new receiving phase.

Most electronic devices require different supply voltages for different sections of the device, and voltage regulators are usually used to generate the different supply voltages. A voltage regulator receives its voltage from a voltage source, e.g. from a battery, and one kind of regulator a so-called linear regulator comprises basically three sections: a reference voltage source generating the reference voltage, a differential or a so called error amplifier, and an admitting or output element, which is usually a transistor. A simplified diagram of the regulator is shown in FIG. 1, where the reference voltage $V_{Ref}$ generated by the reference voltage source 1 is connected to one input 6 (non-inverting input) of the error amplifier 2, the output 8 of the error amplifier is connected the base of the output transistor 3, and the collector of the output transistor 3 is connected as feedback to the second input 7 (inverting input) of the error amplifier 2. The collector of the output transistor is connected to the supply voltage $V_{Bat}$ (which is regulated), which is supplied by e.g. a battery, and the output $V_{Out}$ of the voltage regulator is obtained at the common junction 4 of the output transistor emitter and the error amplifier feedback, whereby a capacitor 5 is usually connected between the point 4 and ground GND to stabilize the circuit so that it will not oscillate.

The voltage regulator consumes substantial power, and as electronic devices such as mobile phones usually have several regulators in order to generate several different voltages, the combined power consumption of several regulators is a substantial part of the total power consumption of the electronic device, particularly of a mobile phone when it is in said power saving mode. However, the power consumption of the regulator was not considered, even if it was tried to reduce the power consumption of other circuits in the power saving mode. The power consumption of the regulator comprises the power consumed in each regulator section:

The power consumption of the reference voltage source is usually 10–500 μA. If there are several voltage regulators, then all regulators usually use a common reference voltage source. In mobile phones the power consumption is usually about 150 μA, including the buffers;

The base current of the output transistor, which is of the order of the output current of the regulator divided by the transistor gain. This current mainly depends on the current consumed by the load, which is connected to the regulator output;

The power consumption of the error amplifier. In a mobile phone the error amplifier usually consumes about 100 μA.

The output current flowing in the output line $V_{Out}$ of the regulator shown in FIG. 1 also depends on the power consumption of the buffer stage of the error amplifier.

The functions of an electronic device, such as a radiotelephone, are typically divided in several sections, so that each section receives its supply voltage from a voltage regulator circuit of its own. Typically several such regulator circuits are then integrated in one IC circuit (e.g. 5 regulators in one IC circuit) . Each regulator circuit is dimensioned according to the maximum current occurring in the telephone's different operational modes. Then the idle current (the "quiescent current", or the basic current consumption which is independent of the output load, or the current consumption of the circuit when the load current is zero) will be proportional to the respective maximum current output ability.

The power consumption of a mobile phone varies substantially in different operational modes. Particularly, some mobile phone systems exhibit a so called idle mode (a listening mode, where the paging channel is listened to), which typically exhibits a short active period, when the mobile phone receives a paging message from the base station so that the power consumption of different circuits is rather high, and a rather long idle period, when the mobile phone waits for a paging message so that the power consumption of different circuits is rather low. For example, in a GSM telephone the length of the active period may have be of the order of 40 ms, and the idle period between the active periods may be of the order of 2 seconds. In this context all circuits, or at least the main part of the respective circuits, still require a supply voltage also during the rest period, so that single regulators cannot be switched off in order to reduce the power consumption of the regulator circuits.

SUMMARY OF THE INVENTION

The object of the present invention is to present a method and a circuit, with which the power consumption of an electronic device, preferably a battery powered device, can be reduced in order to increase the operational time of the battery. The invention is based on the perception to reduce the power consumption of the electronic device comprising at least one voltage regulator by switching off and on said at least one regulator according to a predetermined duty cycle during such periods when a circuit supplied by said at least one regulator is in a mode consuming low power (power saving mode).

In the invention each regulator unit is switched off (into what is referred to herein as the power down mode) at a suitable pulse ratio during such periods when the electronic device is in a passive mode and consumes low power, e.g. when in a stand-by or power saving mode, or when it is on, but does not actively perform its normal functions. In a mobile phone this may be effected during the a so called rest period (i.e. between receiving of paging messages, or between the active periods of the idle made). This switching off is possible during periods of said type, because during these periods the added power consumption of all circuits is negligible. The outputs of the regulators may be provided with a accumulating component, usually a capacitor, which accumulates sufficient current during such periods during the passive mode when the regulators are switched on, so that said accumulating components contain sufficient current to supply the circuits also during those periods of the duty cycle when the regulators are switched off. The transition into this saving or passive mode may be realized by a control signal supplied by the timing sections of the electronic device, e.g. of a mobile phone, whereby the timing signal can be defined to be an active signal only during the idle period (of course the timing circuit will know when the electronic devise will be in the respective "idle mode", or in a corresponding low current mode). Then the period of this control pulse is short compared toe the duration of the idle state. The switching periods of the regulator may be e.g. of the order of 1 ms on and 10 ms off, when the idle period of mobile phones (GSM) usually are or the order of two seconds. The decreased power consumption is thus realized as the idle current of the regulator circuits decrease, because the regulators may be switched off most of the time, e.g. at a ratio of 10:1, as was mentioned above, compared to the period when they are switched on.

The method according to the invention is characterized in that at least one of the regulators is switched off according to a predetermined duty cycle. The electronic device according to the invention is correspondingly characterized in that it comprises a means to supply to the control input, in accordance with a predetermined duty cycle, a signal switching off and on said at least one regulator.

BRIEF DESCRIPTION OF THE DRAWINGS

The invention is described in detail below with reference to the enclosed drawings, in which:

FIG. 2 shows a block diagram and FIG. 3 a circuit diagram of prior art practice to implement a plurality of so-called linear regulators in an electronic device. The regulators REG1–REG4 can be integrated on e.g. one integrated circuit, whereby they are usually realized so that each regulator REG1–REG4 includes a power amplifier 12, 22, 32, 42 and an output transistor 13, 23, 33, 43, but each differential amplifier receives a reference voltage from a common reference voltage source $V_{Ref}$ which can be e.g. the battery of the electronic device. In the solution shown in FIG. 2 there are four regulators REG1–REG4 realized in this way, each of them providing one voltage output OUT1–OUT4. With the power consumption figures mentioned above the regulators REG1–REG4 of a mobile phone comprising four regulators in an arrangement according to FIGS. 2 and 3 consume an idle current of 150 μA+4×100 μA=550 μA.

FIG. 4 shows a block diagram of the solution according to the invention to reduce the power consumption of an electronic device by reducing the power consumption of at least two regulators: FIG. 4 illustrates by way of example an embodiment with four regulators, corresponding to that of FIG. 2. According to the invention the power consumption is reduced by switching off and on one or more of the regulators REG1–REG4, according to a predetermined duty cycle during a period, when the circuits supplied by the regulators REG1–REG4 are in a mode consuming a low current. Each regulator has an intermediate input which is connected to the interface POWER DOWN and which can be supplied with a signal switching off the regulator. The signal to the POWER DOWN interface can be supplied from the device's timing section or control unit (not shown in the figure), which could be e.g. a microprocessor, or from a source outside the device. The signal is supplied to the POWER DOWN interface when it is known that the electronic device is in a mode consuming a low current.

FIG. 6 shows as a pulse diagram the timing of the POWER DOWN signal. The top pulse diagram shows as an example how the invention is utilized in a mobile phone. Mobile phone systems use a so called idle mode (listening mode, listening to the paging channel), typically exhibiting a short active period during which a mobile phone receives a paging message from the base station, and during which the different circuits have a rather high power consumption, and a rather long rest period, during which the mobile phone waits for a paging message, and during which the different circuits have a very low power consumption. In a GSM telephone the length of the active period is about 40 ms, and the idle period between the active periods is of the order of 2 seconds. Then the POWER DOWN signal must keep all regulators switched on at least when the electronic device is in the active mode (pulse high, e.g. 40 ms) or in the case of the mobile phone, at least during the active period of the idle mode. In order to secure that the regulators REG1–REG4 are not inadvertently switched off too early, the POWER DOWN signal's on-period (pulse high) may be made longer that this active period, as is shown in FIG. 6, so that the POWER DOWN signal's power saving period, during which the regulators, according to the invention, are switched on and off in accordance with the duty cycle during a period, which then will be correspondingly slightly shorter than the idle period. Thus, when the electronic device supplies a signal that it's circuits are in a low power mode, then the POWER DOWN signal is switched on (pulse high, e.g. 1 ms) and off (pulse low, e.g. 10 ms) in accordance with, the predetermined duty cycle, and the POWER DOWN signal is switched into the on-period before the circuits of the electronic device again are switched into the active mode, so that all regulators REG1–REG4 will be switched on in a continuous on-state.

FIG. 5 shows as a circuit diagram the realization of the block diagram corresponding to FIG. 4. Here the regulators REG1–REG4 are switched on and off by controlling the differential amplifiers 12, 22, 32, 42 into in accordance with the duty cycle, whereby the POWER DOWN signal is supplied to the differential amplifiers.

Figure 1:
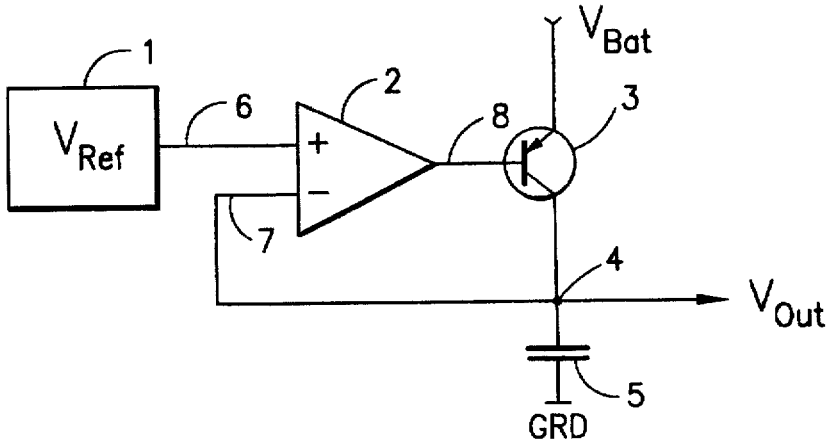
FIG. 1 shows a circuit diagram of a general embodiment of a voltage regulator according to prior art.
Figure 2:
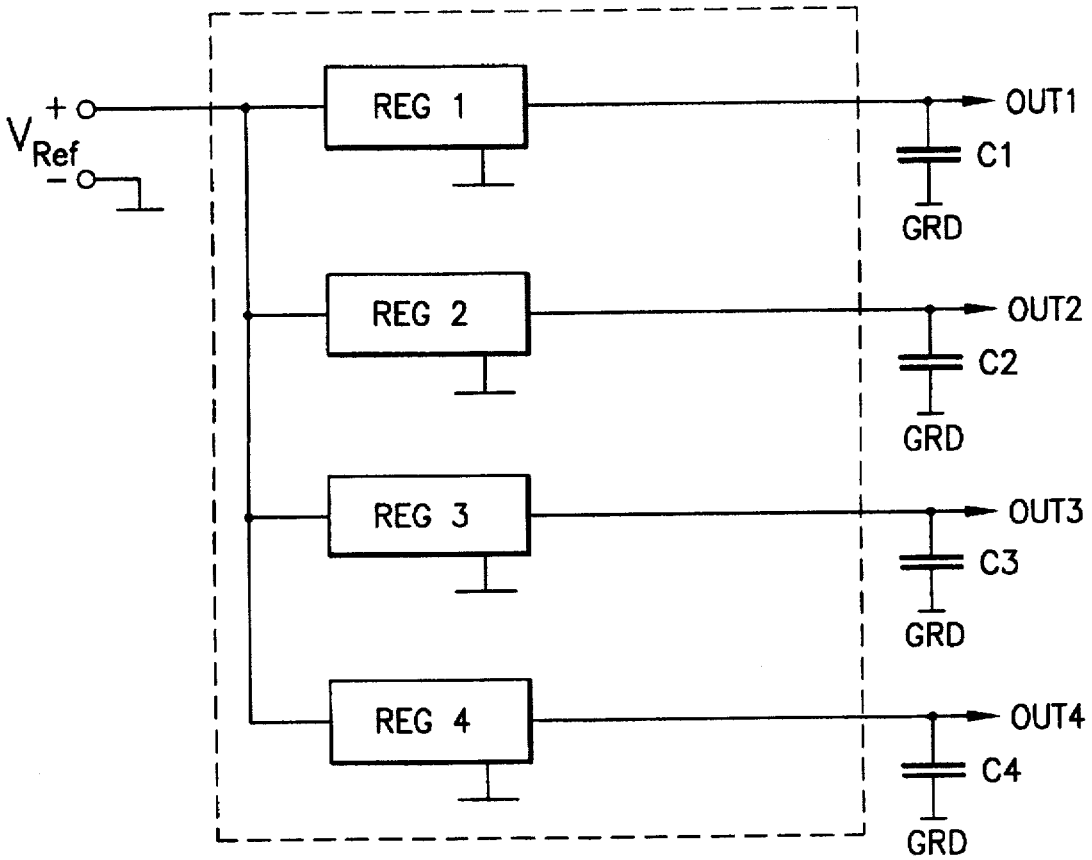
FIG. 2 shows the block diagram of an embodiment according to prior art comprising several voltage regulators.
Figure 3:
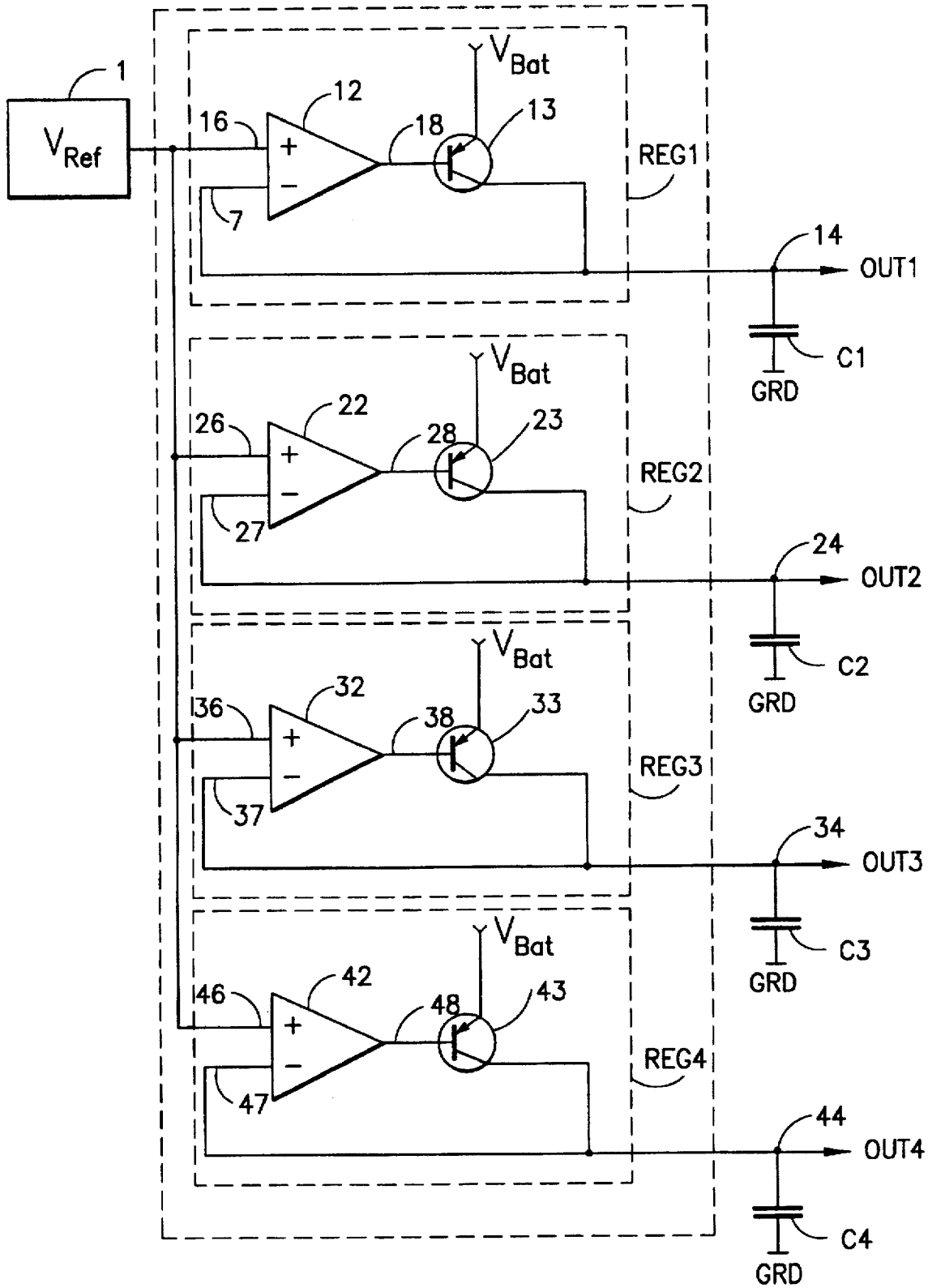
FIG. 3 shows a circuit diagram .of an embodiment according to prior art comprising several regulators.
Figure 4:
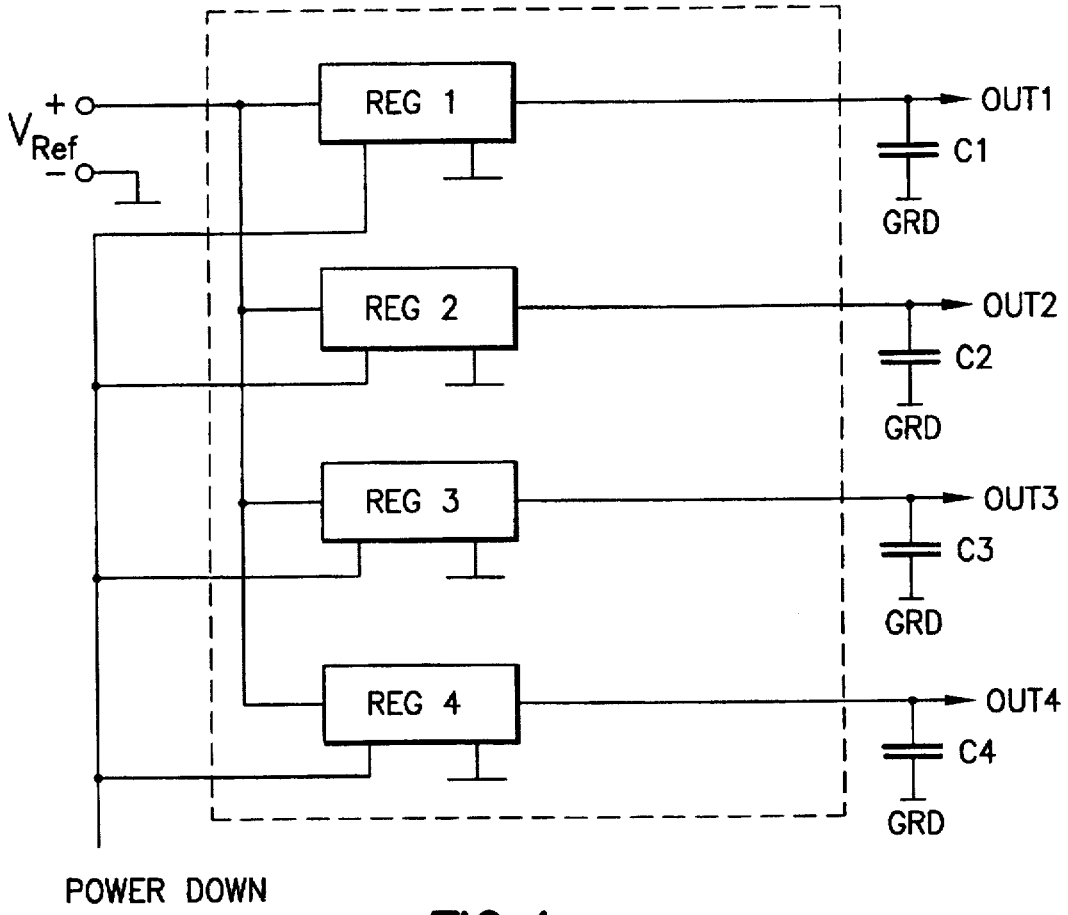
FIG. 4 shows a block diagram of a solution according to the invention comprising several regulators.
Figure 6:
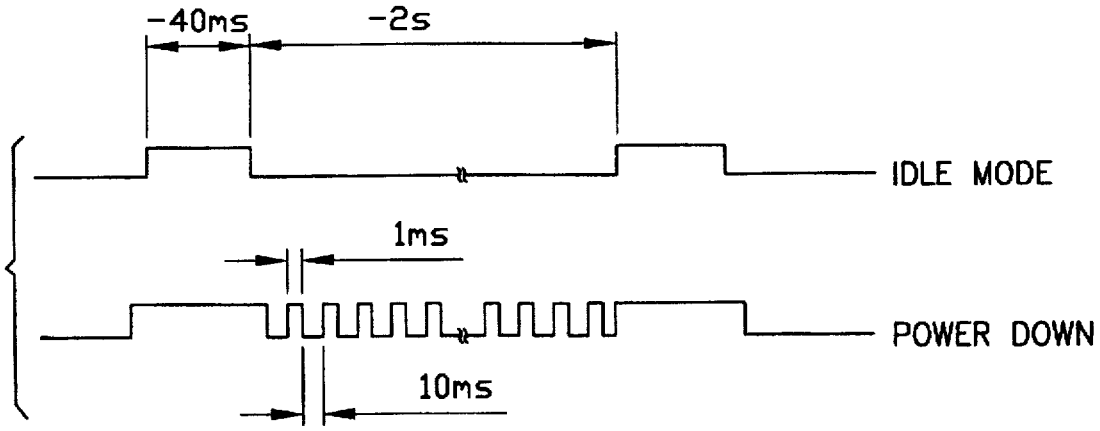
FIG. 6 shows a pulse diagram of the timing and switching used in the invention.
Figure 5:
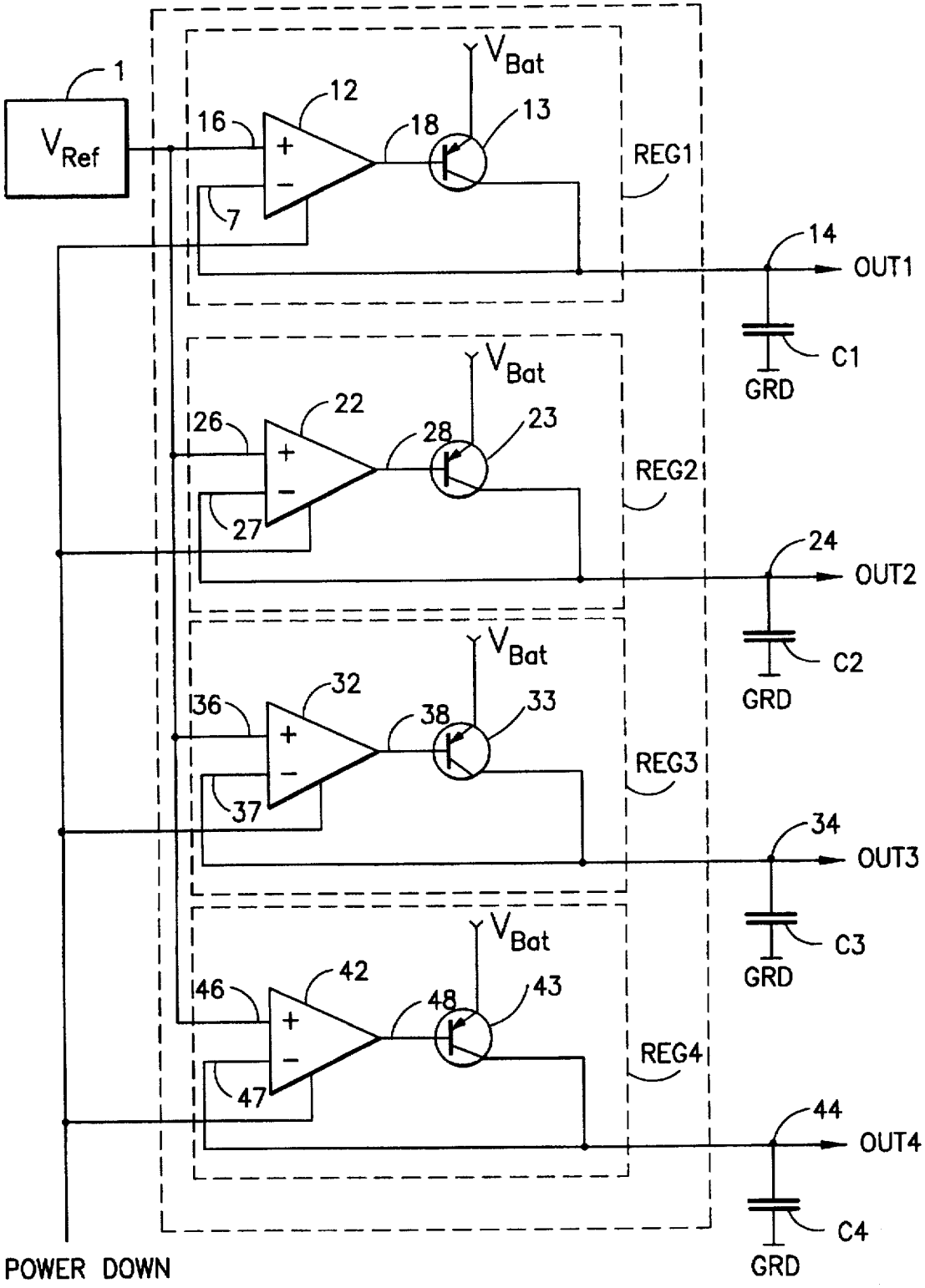
FIG. 5 shows a circuit diagram of a solution according to the invention comprising several regulators.

Both in the circuit diagram of FIG. 4 and in the block diagram of FIG. 5 the switching off of the regulators is realized in a way known to a person skilled in the art by controlling the regulator via its POWER DOWN input into the off state. This property of a regulator and switching the regulator off in this way is known to a person skilled in the art, and here a more detailed embodiment will not be described more exactly.

Figure 7:
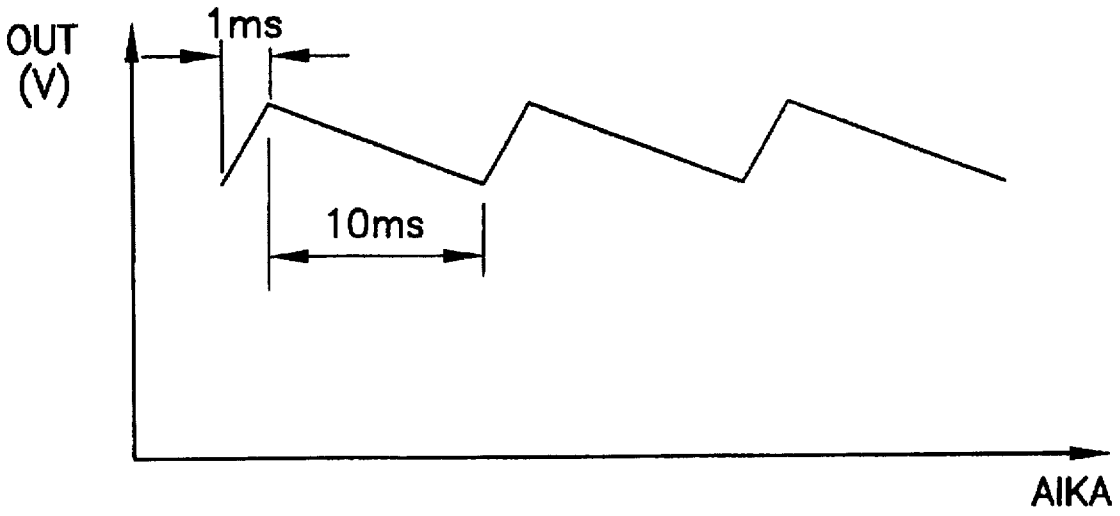
FIG. 7 shows the behavior of the regulator's output voltage as a function of time during a duty cycle according to the invention.

FIG. 7 illustrates the behavior of the output voltages OUT as a function of the time. As the circuits supplied by the regulators have a low power consumption in the idle mode, the regulators have sufficiently time to provide the required current during a short period, and therefore the regulators may be switched off for a longer time than they are switched on, and the ratio of the duty cycle could be selected as 10:1 (e.g. 10 ms off: e.g. 1 ms on). With the power consumption figures mentioned above the regulators REG1–REG4 then have a power consumption of (150 μA+N×100 μA)/10=15 μA+N×10 μA in the idle mode, so that the power consumption will be 55 μA in the case with four regulators, which is considerably less that the normal power consumption (550 μA). if we use a duty cycle ratio of 20:1, then the power consumption can be reduced even more, to the half (27,5 μA). When the regulators are switched on (1 ms), then the accumulating component, preferably a capacitor C1–C4 at the output of each regulator will accumulate current, which is sufficient to supply the circuits connected to the regulator's output during that period (10 ms) of the duty cycle when the regulators are switched off, until the regulators are switched on again to supply the regulator's output voltage to the accumulating capacitors. Therefore a certain voltage drop is allowable, however so that the voltage remains over a certain limit, which causes no disturbances because there is almost no activity in the circuits supplied by the regulators. This voltage behavior is shown in FIG. 7. The pulsing of the regulators according to the invention can be realized in all regulators of the electronic device, only in a part of them, or in only one regulator.

With the aid of the invention it is simple to reduce the power consumption of an electronic device comprising at least one regulator by switching on and off at least one regulator of the electronic device according to a predetermined duty cycle during periods when the normal power capacity is not required by the regulator. This situation can occur when the electronic device is on but does not actively perform its functions, but also when in the device a circuit supplied by a certain regulator is switched into a power saving mode. The invention is applicable to electronic devices of different types, particularly in battery powered devices, such as mobile phones, portable computers, portable telefax terminals, portable copying machines, portable oscilloscopes and other measuring equipment, and for instance in portable hospital equipment, and so on, whereby it is possible to increase the operational time of the battery.

I claim:

1. An electronic device, comprising:

at least one circuit having a normal operational mode having first power consumption requirements and a passive mode in which said at least one circuit has second reduced power consumption requirements;

a voltage regulator for supplying a regulated voltage to the circuit;

switching circuitry operable, when the circuit is in said passive mode having said reduced power requirement to switch the voltage regulator on and off according to a predetermined duty cycle wherein the voltage regulator does not consume power when off, a current accumulating component connected to the voltage regulator for accumulating current when the voltage regulator is switched on and to provide current to the circuit when the voltage regulator is switched off and not consuming power.

2. An electronic device as in claim 1, wherein the voltage regulator is a linear voltage regulator which comprises an error amplifier and an output element.

3. An electronic device as in claim 2 wherein the electronic device comprises a plurality of said circuits supplied by a corresponding voltage regulator.

4. An electronic device as in claim 3, wherein said voltage regulators are supplied by a single voltage reference source.

5. An electronic device as in claim 4, further comprising a single auxiliary input by which a switching signal can be supplied to the voltage regulators.

6. An electronic device as in claim 1 wherein the current accumulating circuit is a capacitor.

* * * * *